United States Patent [19]

Sambor

[11] Patent Number: 5,058,322

[45] Date of Patent: Oct. 22, 1991

[54] MOVABLE WINDOW ASSEMBLY

[75] Inventor: Stephen P. Sambor, Southfield, Mich.

[73] Assignee: Ford Motor Company, Dearborn, Mich.

[21] Appl. No.: 563,016

[22] Filed: Aug. 6, 1990

[51] Int. Cl.[5] ..... E05F 11/48

[52] U.S. Cl. ..... 49/352; 49/374; 49/348

[58] Field of Search ..... 49/348, 349, 352, 374, 49/502

[56] References Cited

U.S. PATENT DOCUMENTS

| | | | |
|---|---|---|---|
| 1,218,130 | 3/1917 | Ternstedt . | |
| 3,897,654 | 8/1975 | Kouth et al. . | |
| 4,020,593 | 5/1977 | Salomon et al. . | |
| 4,597,223 | 7/1986 | Shiraishi et al. . | |
| 4,633,613 | 1/1987 | Kobayashi et al. . | |
| 4,730,414 | 3/1988 | Nakamura et al. | 49/352 X |
| 4,783,930 | 11/1988 | Tiesler | 49/374 |
| 4,819,377 | 4/1989 | Bauer et al. | 49/349 X |
| 4,829,711 | 5/1989 | Sambor | 49/352 X |

*Primary Examiner*—Rodney M. Lindsey
*Assistant Examiner*—Jerry Redman
*Attorney, Agent, or Firm*—Daniel M. Stock; Roger L. May

[57] ABSTRACT

A lowerable window assembly for automobiles is provided which employs a pulley arrangement connected to an actuator assembly which operates to both lift and lower the window and to rotatively drive the actuator when the window is fully raised to impart lateral movement to the lower edge of the window which the actuator assembly is attached.

11 Claims, 4 Drawing Sheets

MOVABLE WINDOW ASSEMBLY

BACKGROUND OF THE INVENTION

The present invention relates generally to movable automobile windows and to actuators and regulators therefor, and more specifically to such movable windows having actuators for effecting lateral movement with respect to the automobile body.

DESCRIPTION OF THE PRIOR ART

Modern automotive designs have incorporated flush positioning of glass surfaces with respect to outer surfaces of the automobile body for aerodynamic and aesthetic reasons. One particularly challenging design problem effecting the desired flushness has been that encountered in achieving flushness at the belt line of the automobile vehicle adjacent its lowerable windows. A relatively substantial offset has often been necessary because the windows are mounted to move in a continuous straight or curvilinear path from a position well within the vehicle body.

Applicant provided an effective solution to this design problem in the actuator assembly described and claimed in his U.S. Pat. No. 4,829,711 patent. This actuator assembly shifts the lower edge of the glass laterally outwardly with respect to the vehicle body in response to a rotative motion input occurring when the glass is in its raised position. Certain disadvantages have been noted, however, in Applicant's previous design. These disadvantages result from the necessity to use the special actuator plate 46 for imparting rotary motion to a spindle member which drives the hub for effecting lateral movement of the glass. The actuator plate, with its generally Y-shaped slot, and the need to provide a pair of driving pins on the spindle member for engaging that slot result in an unduly massive and complex mechanism for effecting the rotary motion input.

SUMMARY OF THE INVENTION

Responsive to the deficiencies of the prior art device, it is an object of the present invention to provide an improved actuator assembly for moving the lower edge of a movable automobile window laterally with respect to the body.

According to one feature of the present invention, a window assembly is provided in which a single flatted cylindrical driving hub of the actuator assembly cooperates with an enlarged circular end portion of a guideway slot to effect rotative movement of the actuator assembly in response to operation of a pulley system.

According to another feature of the present invention, the pulley system includes a cable having a fixed ferrule drivingly engageable with a pulley fixedly mounted on the actuator slide portion.

BRIEF DESCRIPTION OF THE DRAWINGS

These and other objects and features will be apparent to those skilled in the automotive window arts upon reading the following description with reference to the accompanying drawings in which.

DESCRIPTIONS OF THE PREFERRED EMBODIMENT

Figure 1:
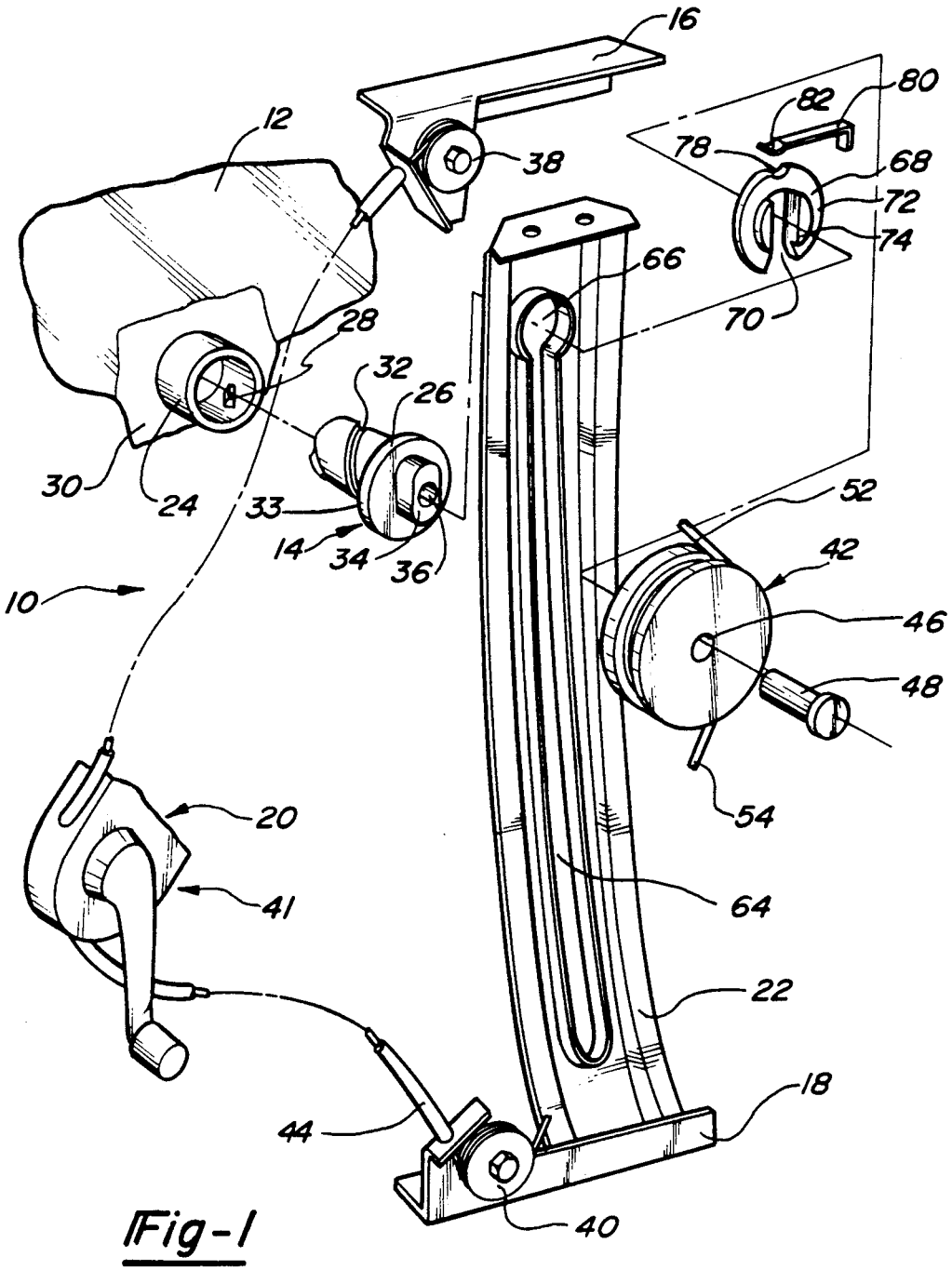
FIG. 1 is an exploded perspective view of a movable automotive window assembly according to the present invention.

Turning now to the drawings, and in particular to FIG. 1 thereof, a window assembly 10 according to the present invention is illustrated in an exploded view with the components of the assembly generally arranged as they would be when the window assembly 10 is assembled into an automobile door (not shown) for raising and lowering a window, shown in part at 12. A window actuator assembly 14 of the type disclosed in Applicant's U.S. Pat. No. 4,829,711 operatively engages the window 12 to effect raising and lowering movement of the window 12 with respect to the vehicle door and to provide lateral movement.

The window assembly 10 further includes an upper body mounting plate 16, a lower body mounting plate 18, a pulley assembly 20 and a guideway 22. Upper and lower body mounting plates 16 and 18 are fixedly secured within the automobile door proximate the belt line and door sill line, respectively, and include suitable mounting structure for carrying both the pulley assembly 20 and the guideway 22.

It will be understood that the window assembly 10 of the present invention operates to raise and lower the window 12 and to move it laterally when in its raised position by moving the actuator assembly 14 vertically in the path established by the guideway 22 and rotating a portion of the actuator assembly 14 when it is moved to its fully raised position with respect to the guideway 22.

The actuator assembly is illustrated as comprising generally a hub portion 24 and a spindle portion 26 which cooperate in the manner described in Applicant's U.S. Pat. No. 4,829,711 to effect lateral movement of the window 12 with respect to the automobile door. The hub 24, accordingly, has internally projecting lugs 28 and is fixedly secured as by a mounting plate 30 to the window 12. The spindle 26 includes helically extending grooves 32 for drivingly engaging the lugs 28, and it includes an end flange 33 from which projects a generally cylindrical slide portion 34 having a central attaching aperture 36.

The pulley assembly 20 is illustrated as including an upper pulley 38 rotatably mounted on the upper body mounting plate 16, a lower pulley 40 rotatably mounted on the lower body mounting plate 18, a cranking pulley illustrated as a handle assembly 41, preferably mounted on the interior of the door, and a drive pulley 42, all interconnected by a cable 44. Operation of the handle 41 draws the cable about the upper and lower pulleys 38, 40, respectively, and effects movement of the drive pulley 42. The drive pulley 42 includes a central through-bore 46 for receiving a mounting fastener such as the pin indicated at 48 for insertion in the aperture 36 of the spindle 26 to fixedly secure the drive pulley 42 with respect to the spindle 26 and, hence, actuator assembly 14.

Figure 2:
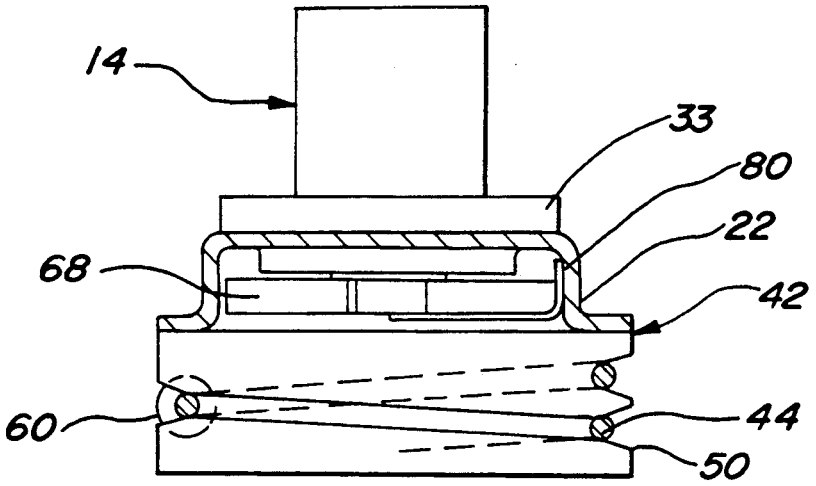
FIG. 2 is a top view partially in cross-section.

As may best be seen in FIG. 2, the drive pulley 42 includes a helically extending cable track 50 about which the cable 44 is wrapped to provide an upper portion 52 and a lower portion 54, through which the drive pulley 42 is pulled from the upper pulley 38 and the lower pulley 40, respectively. The outer periphery 56 of the drive pulley 42 is modified to define a substantially cylindrical pocket, as indicated generally at 58 for receiving a generally cylindrical ferrule 60 that is fixedly secured to the cable 44. The arrangement of the ferrule 60, with respect to the drum pulley 42 may be really understood by reference to FIG. 3.

The guideway assembly 22 may be constructed as a substantially vertically extending guideway 62 which may be curvilinearly arrayed with the vehicle, as illustrated. The guideway 62 is formed therethrough a straight slot 64 sized to slidingly receive the slide portion 34 of the actuator spindle 26 The slot 64 extends vertically to encompass a lower position corresponding to the lowered position of the window 12 and an upper position corresponding to the window's raised position At this upper location, an enlarged circular end portion 66 is formed directly intersecting the straight slot 64. A collar member 68 is rotatably mounted in this enlarged end portion 66 and includes a central U-shaped slot 70 positionable in axial registration with the straight slot 64 upon insertion in the guideway 62 from the rear, as viewed in FIG. 1. The collar member 68 further includes a generally cylindrical base portion 72 for abuttingly engaging the rear surface of the guideway 62, and a pair of chordal rotating lugs 74 spanning the slot 70 for effecting rotative engagement within the enlarged end portion 66. The outer periphery 66 of the collar member 68 includes depression 78, and a resilient retainer 80 is mounted in cantilever fashion on the guideway 22 and includes a depressed tip 82 for engagement with the depression 78.

OPERATION OF THE PREFERRED EMBODIMENT

Figure 3:
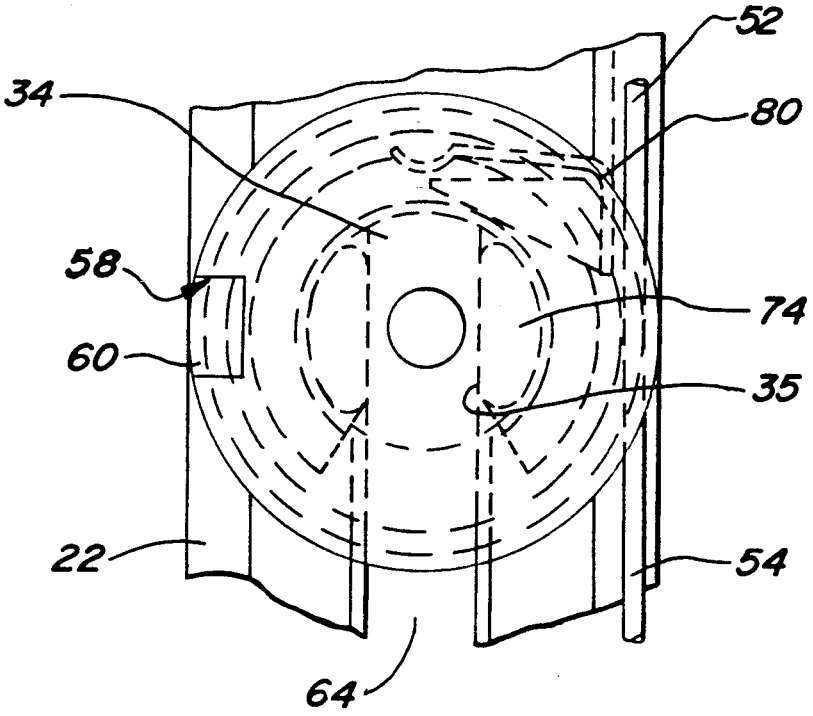
FIG. 3 is a front elevational view shown in the position in which the window has been lifted to its fully raised position.
Figure 4:
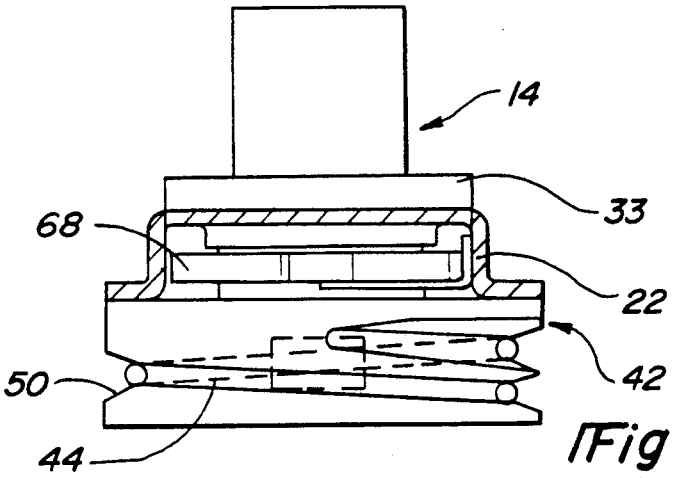
FIG. 4 is a view similar to FIG. 2 illustrating component positions with the actuator having been rotated to effect lateral window movement.
Figure 5:
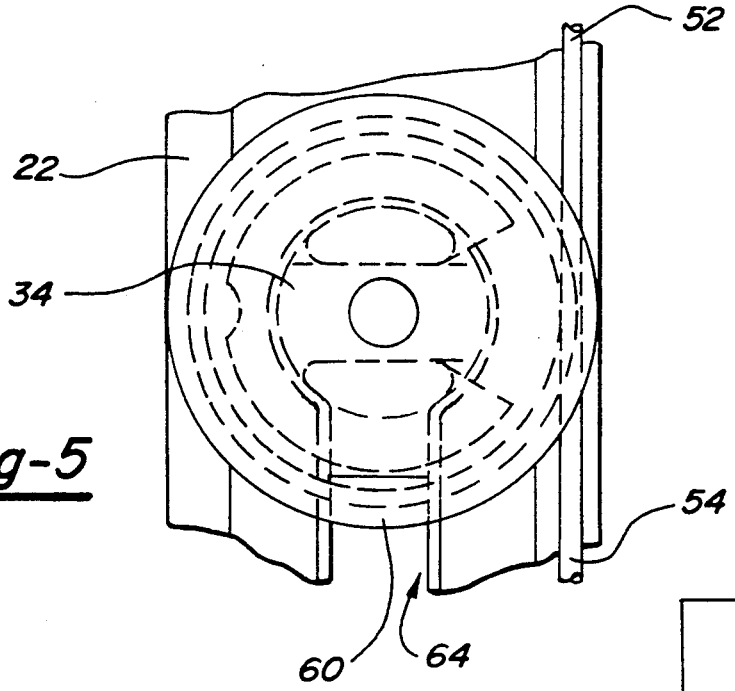
FIG. 5 is a front elevational view of the components of FIG. 4.
Figure 6:
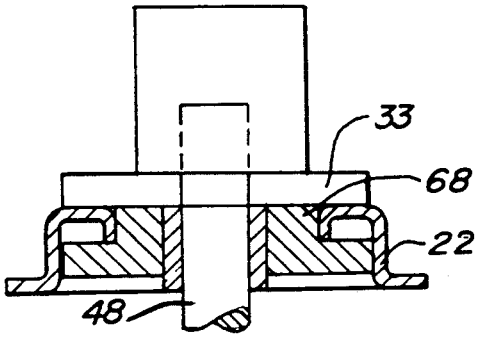
FIG. 6 is a cross-sectional view of the driving interconnection of the actuator assembly in the pulley system in the FIG. 5 position.
Figure 7:
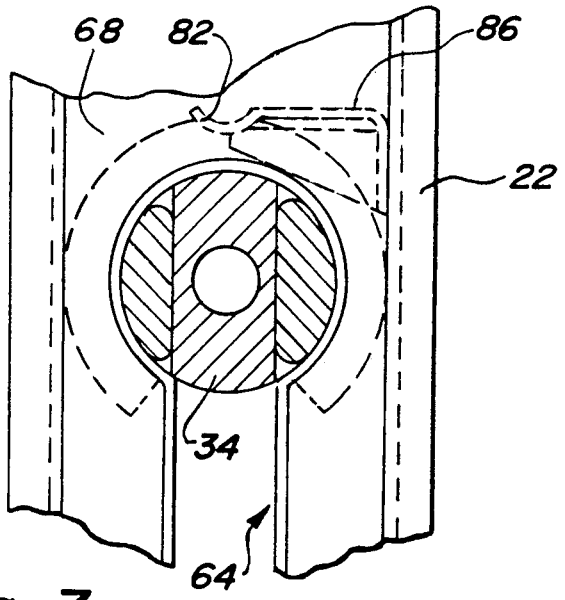
FIG. 7 is a cross-sectional view of the driving interconnection of the relationship between the actuator assembly and the guideway in the fully raised position of FIG. 2.
Figure 8:
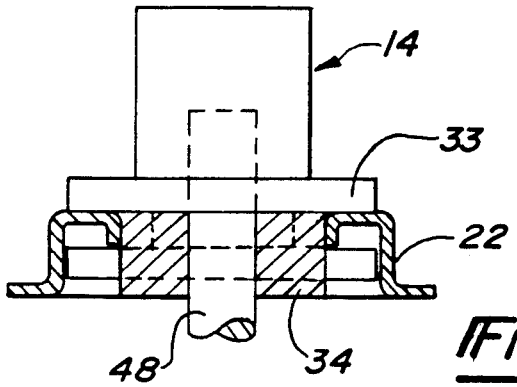
FIG. 8 is a cross-sectional view taken along lines 8—8 of FIG. 7.
Figure 9:
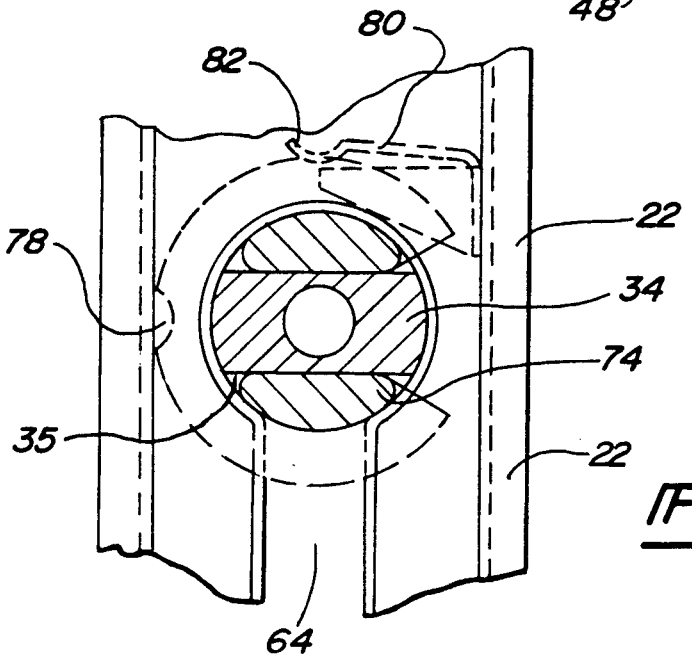
FIG. 9 is a cross-sectional view similar to FIG. 7 with the components in the relative positions of FIG. 5.

Rotation of the handle assembly 41 in the appropriate direction to effect pulling the cable 44 over the upper pulley 38 results in drawing on the upper portion 52 of the cable, tending to rotate the drive pulley 42 in the counterclockwise direction, as viewed in FIG. 1 as the cable operates to draw the ferrule 60 to follow with the movement. Because the drive pulley 42 is fixedly secured to the spindle 26, however, the upward pull of the cable portion 52 moves the slide portion 34 vertically upward within the straight slot 64 of guideway assembly 22. Upward movement may continue until the flatted sides 35 of the slide portion 34 are received in the slot 70 of the collar 68. The collar 68 maintains the facing relationship of the slot 70 with respect to the straight slot 64 by the relatively light load imposed by the retainer 80. Upon entry of the slide portion 34 into the slot 70, as shown in FIG. 3, further movement of the cable 44 in the lifting direction results in rotation of the spindle 26 and the collar 68 as the ferrule 60 rotatively drivingly engages the pulley 42 to move it in a counterclockwise direction from the position shown in FIG. 3 to that shown in FIG. 5. This, accordingly, effects lateral movement of the window 12 since rotation of the spindle 26 drives the hub 24 outwardly with respect to it. It will be noted that the rotative force transmitted from the cable 44 is sufficient to overcome the light restraining force imposed by the retainer 80, and the depression 82 of the retainer 80 is disengaged from the depression 78, as may best be seen in FIG. 9. Reversal of movement of the cable 44 drives the spindle 26 and the collar 68 in the opposite direction returning to the position of alignment of the drive portion 44 with the straight slot 64 under influence of the ferrule 60 so that further movement draws the slide portion 34 into engagement with the slot 66. All motion of the cable 44 in drawing on the lower position 54 effects downward movement of the drive pulley 42 and consequent lowering of the window 12.

While only one embodiment of the window assembly of the present invention has been disclosed, others may occur to those skilled in the automotive window arts which will not depart from the scope of the appended claims.

I claim:

1. A window assembly for an automobile body of the type vertically movable between lowered and raised positions and having an actuator assembly for moving the window laterally with respect to the automobile body when the window is moved to its raised position in response to a rotary movement input to the actuator assembly, the window assembly comprising:

a guideway track assembly fixedly secured to said body adjacent said window and having a guideway formed therethrough as a straight slot extending vertically between positions for responding to said raised and lowered window positions;

means defining an enlarged circular end portion in said guideway at the end of said slot corresponding to said raised window position;

means defining a generally cylindrical slide portion on said actuator assembly rotatably drivingly engageable to effect said rotary movement input and having a pair of diametrically opposed flattened sides slidingly engageable with said guideway slot and rotatably engageable with respect to said circular end portion; and pulley means operative to both move said slide portion from said lowered window position to said raised window position and thereupon to directly rotatably engage said slide portion to effect said lateral window movement.

2. A window assembly as defined in claim 1 and further comprising a collar member rotatably received in said circular end portion and having a U-shaped slot alignable in a first position with said guideway slot for receiving said slide portion.

3. A window assembly as defined in claim 2 and further comprising retainer means for resisting rotational movement of said collar from said first position.

4. A window assembly as defined in claim 1 wherein said pulley means comprises:

a cable;

a cable actuator operable to pull said cable in either longitudinal direction;

a pair of vertically spaced idler pulleys positioned above and below said guide track assembly;

a drum pulley fixedly secured to said slide portion; and ferrule means defining a fixed rotatively driving connection between said cable and said drum pulley.

5. A window assembly for an automobile body of the type vertically movable between lowered and raised positions and having an actuator assembly for moving the window laterally with respect to the automobile body when the window is moved to its raised position in response to a rotary movement input to the actuator assembly about a longitudinal axis, the window assembly comprising:

a guideway track assembly fixedly secured to said body adjacent said window and having a guideway formed therethrough as a straight slot extending vertically between positions for responding to said raised and lowered window positions;

means defining an enlarged circular end portion in said guideway at the end of said slot corresponding to said raised window position;

means defining a generally cylindrical slide portion on said actuator assembly rotatably drivingly engageable to effect said rotary movement input and having a pair of diametrically opposed flattened sides slidingly engageable with said guideway slot and rotatably engageable with respect to said circular end portion; and pulley means mounted on said actuator assembly coaxially with said longitudinal axis and operative to both move said slide portion from said lowered window position to said raised window position and thereupon to directly rotatably engage said slide portion to effect said lateral window movement.

6. A window assembly as defined in claim 5 and further comprising a collar member rotatably received in said circular end portion and having a U-shaped slot alignable in a first position with said guideway slot for receiving said slide portion.

7. A window assembly as defined in claim 6 and further comprising retainer means for resisting rotational movement of said collar from said first position.

8. A window assembly as defined in claim 5 wherein said pulley means comprises:

a cable;

a cable actuator operable to pull said cable in either longitudinal direction;

a pair of vertically spaced idler pulleys positioned above and below said guide track assembly;

a drum pulley fixedly secured to said slide portion; and ferrule means defining a fixed rotatively driving connection between said cable and said drum pulley.

9. A window assembly for an automobile body of the type vertically movable between lowered and raised positions and having an actuator assembly for moving the window laterally with respect to the automobile body when the window is moved to its raised position in response to a rotary movement input to the actuator assembly about a longitudinal axis, the window assembly comprising:

a guideway track assembly fixedly secured to said body adjacent said window and having a guideway formed therethrough as a straight slot extending vertically between positions for responding to said raised and lowered window positions;

means defining an enlarged circular end portion in said guideway at the end of said slot corresponding to said raised window position;

means defining a generally cylindrical slide portion on said actuator assembly rotatably drivingly engageable to effect said rotary movement input and having a pair of diametrically opposed flattened sides slidingly engageable with said guideway slot and rotatably engageable with respect to said circular end portion;

a cable;

a cable actuator operable to pull said cable in either longitudinal direction;

pulley means mounted on said actuator assembly coaxially with said longitudinal axis and operative in response to pulling said cable to move said slide portion from said lowered window position to said raised window position; and means defining a fixed rotative driving connection between said cable and said pulley means to directly rotatably engage said slide portion to effect said lateral window movement.

10. A window assembly as defined in claim 9 and further comprising a collar member rotatably received in said circular end portion and having a U-shaped slot alignable in a first position with said guideway slot for receiving said slide portion.

11. A window assembly as defined in claim 10 and further comprising retainer means for resisting rotational movement of said collar from said first position.

* * * * *